United States Patent [19]

Upsher et al.

[11] Patent Number: 4,813,567

[45] Date of Patent: Mar. 21, 1989

[54] FREIGHT CONTAINERS

[75] Inventors: Stanley M. Upsher, Durbanville; Sulaiman Essop, Cape Town, both of South Africa

[73] Assignee: Consani Engineering (PTY) Ltd., Bedfordview, South Africa

[21] Appl. No.: 96,717

[22] Filed: Sep. 14, 1987

[30] Foreign Application Priority Data

Sep. 15, 1986 [ZA] South Africa ..... 86/7005

[51] Int. Cl.[4] ..... B65D 7/42

[52] U.S. Cl. ..... 220/5 A; 220/1.5; 220/71

[58] Field of Search ..... 220/5 A, 1.5, 71, 1 B

[56] References Cited

U.S. PATENT DOCUMENTS

| | | | |
|---|---|---|---|
| 3,730,384 | 5/1974 | Ramme | 220/71 |
| 3,971,491 | 7/1976 | Mowatt-Larssen et al. | 220/1.5 X |
| 4,065,022 | 12/1977 | Cainaud | 220/1.5 X |
| 4,593,832 | 6/1986 | Gerhard | 220/1.5 |
| 4,603,788 | 8/1986 | Gerhard | 220/5 A X |
| 4,615,453 | 10/1986 | Taquoi | 220/71 |

FOREIGN PATENT DOCUMENTS

| | | |
|---|---|---|
| 1362461 | 8/1974 | United Kingdom . |
| 1520213 | 8/1978 | United Kingdom . |
| 2013624 | 8/1979 | United Kingdom . |
| 2083445 | 3/1982 | United Kingdom . |
| 2168415 | 6/1986 | United Kingdom . |

OTHER PUBLICATIONS

Jean-Pierre Taquoi-Bignier Schmid-Laurent (B.S.L.) 2.481.678, (A.1) (80 09816)-30 Avril 1980. B 65 D 88/06. 90/12.

Container Trafic Container Construction. Universal Bulk-Handling Equipment Ltd. 23 Oct., 1969 (24 Oct. 1968), No. 50462/68. 1,273,356.

Examples of Tank Containers as Requested by Adams & Adams.

*Primary Examiner*—Steven M. Pollard

*Attorney, Agent, or Firm*—Ladas & Parry

[57] ABSTRACT

A freight container in the form of a beam tank is disclosed which comprises two end frames (12) and a tank which spans between the end frames. The tank is encircled by strengthening rings (28). Eight saddles (14), four at each end, join the rings (28) and hence the tank to the end frames (12). The end frames comprise vertical and horizontal members (16, 18), ISO corner fittings (20), bracing members (22) and plates (24) welded into the triangular spaces bounded by the members (16, 18, 22). Each saddle (14) comprises a tubular member (32) welded at one end to the end frame. At the other end of the tubular member there is a welded-on plate (34) which closes-off the member (32). A further plate (36) of arcuate section is welded to the member (32) and is also welded to the ring (28). The plate (36) has wings which extend on each side of the member (32) and are welded to the ring (28).

10 Claims, 3 Drawing Sheets

FREIGHT CONTAINERS

This invention relates to freight tank containers for the transportation of liquids, gases or solids in bulk.

BACKGROUND TO THE INVENTION

Two main types of bulk freight tank containers are known. One of these is commonly called a frame tank and comprises the cylindrical tank itself, two rectangular end frames, and girders joining the end frames. The tank is supported by the end frames and girders and little problem is experienced in constructing the frame tank with sufficient strength to prevent the cylindrical tank itself from being damaged as a result of twisting, sagging or flexing. However, a frame tank does have the disadvantage that it has a comparatively great mass and its carrying capacity is reduced commensurately. GB No. 1362461 discloses a tank of this type.

The second type of bulk freight tank container is known as a beam tank. This consists of a cylindrical tank and two end frames. The tank constitutes the only structural element joining the end frames, and is thus unsupported except at its ends. Consequently, it is capable of twisting and sagging. Great care must be taken in constructing the so-called saddles which join the tank to the end frames. If the saddles are not properly constructed then twisting and flexing of the tank can occur to such an extent that it results in damage to the tank and/or to the saddles, or in the saddles separating from the tank or end frames. GB No. 2168415 A, GB No. 1520213, and GB No. 2083445A all disclose beam tanks.

OBJECT OF THE INVENTION

The object of the present invention is to provide a freight container of the beam tank type, of which the saddles are stronger and less prone to damage than are known saddles.

BRIEF DESCRIPTION OF THE INVENTION

According to the present invention there is provided a freight container comprising a pair of rectangular end frames, a tank spanning between the end frames, and saddles connecting the end frames to the tank, each saddle including a tubular member and a plate, one end of each tubular member being welded to the inner face of the adjacent end frame and each plate having a curvature which matches that of the tank, each plate being welded to the outer face of the tank and to the end of the tubular member remote from the end frame.

The tank preferably has an external strengthening ring at each end thereof, said plates being welded to the outer faces of said rings.

The axis of said tubular member is preferably inclined with respect to horizontal, said one end of the tubular member lying in a vertical plane which is skew to the axis of the member.

Each plate preferably comprises a main part which is welded to one of said tubular members and a pair of wings which extend in the circumferential direction on opposite sides of said main part.

BRIEF DESCRIPTION OF DRAWINGS

For a better understanding of the present invention, and to show how the same may be carried into effect, reference will now be made, by way of example, to the accompanying drawings in which.

DETAILED DESCRIPTION OF DRAWINGS

The freight container illustrated comprises a tank 10 and two square end frames 12, the tank 10 and end frames 12 being connected to one another by eight saddles 14. The tank 10 connects the end frames 12 to one another. There are no structural components spanning between the end frames 12 other than the tank 10 but longitudinal members can be provided where protection for the tank is required, where support for other equipment is needed or where access is required. These members do not strengthen the tank significantly.

Figure 5:
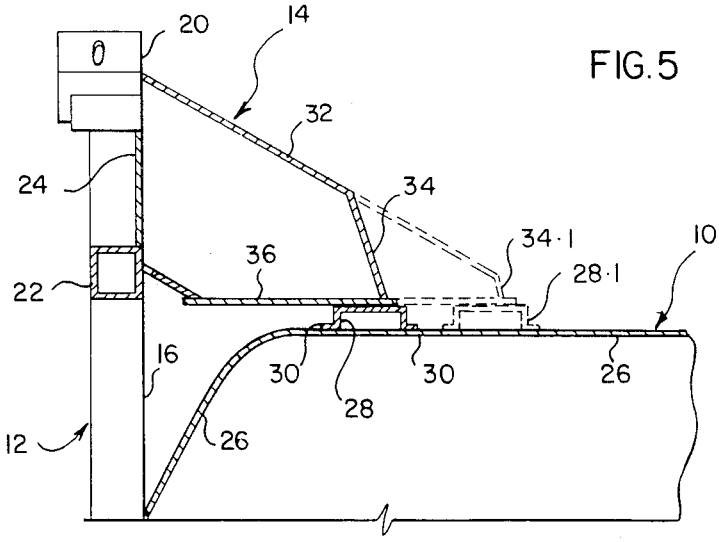
FIG. 5 is a section on the line V—V of FIG. 4 and additionally shows a modified construction.

Each end frame 12 comprises two vertical members 16, two horizontal members 18 and ISO corner fittings 20 (see particularly FIG. 6) at each corner of the frame. The members 16 and 18 are welded to the corner fittings 20. Bracing members 22 extend, at each corner of each frame 12, between the vertical and horizontal members 16 and 18. The members 22 are at approximately 45 degrees with respect to horizontal. A filler plate 24 (see particularly FIG. 5) is welded into each triangular space defined by the members 16, 18 and 22. The face of the plate 24 is flush with the faces of the members 16, 18 and 22.

Figure 1:
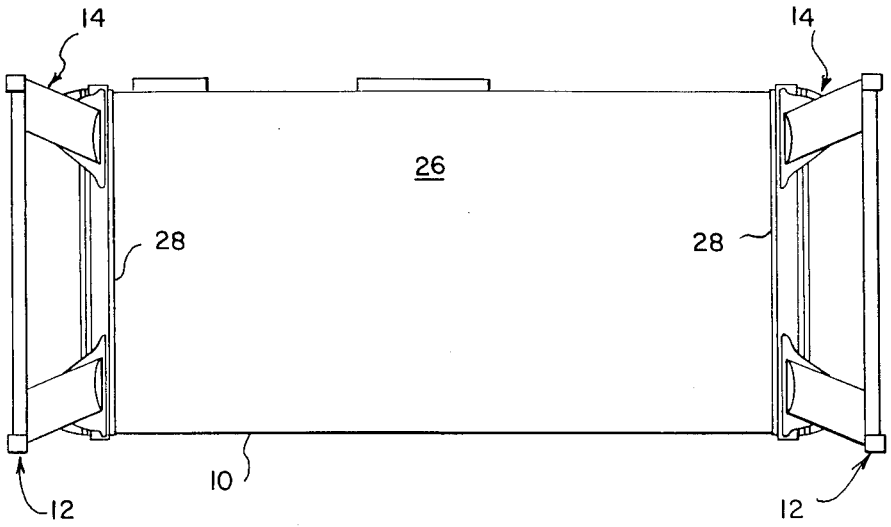
FIG. 1 is a side elevation of a beam tank.
Figure 2:
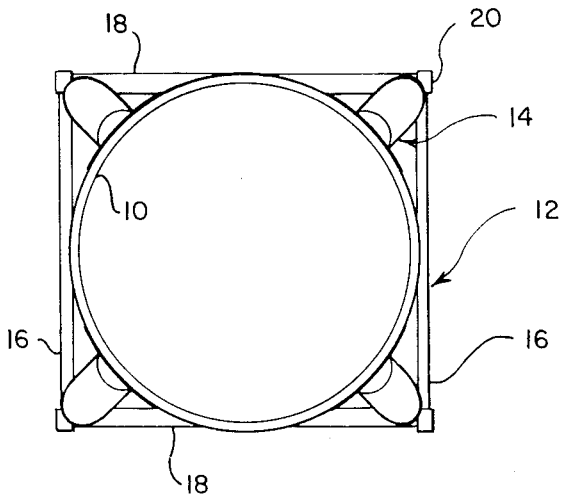
FIG. 2 is a cross-section through the tank of FIG. 1.
Figure 4:
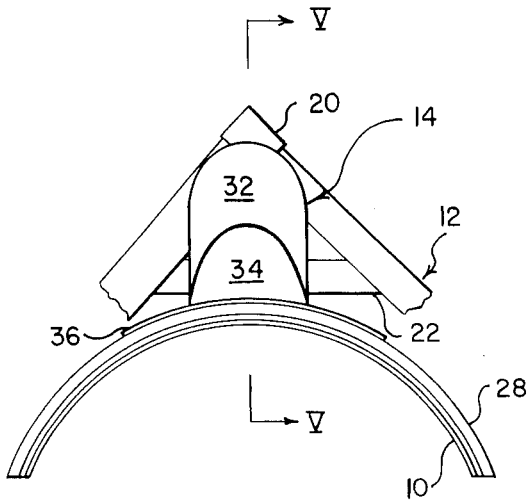
FIG. 4 is a view on the arrow A of FIG. 3.
Figure 3:
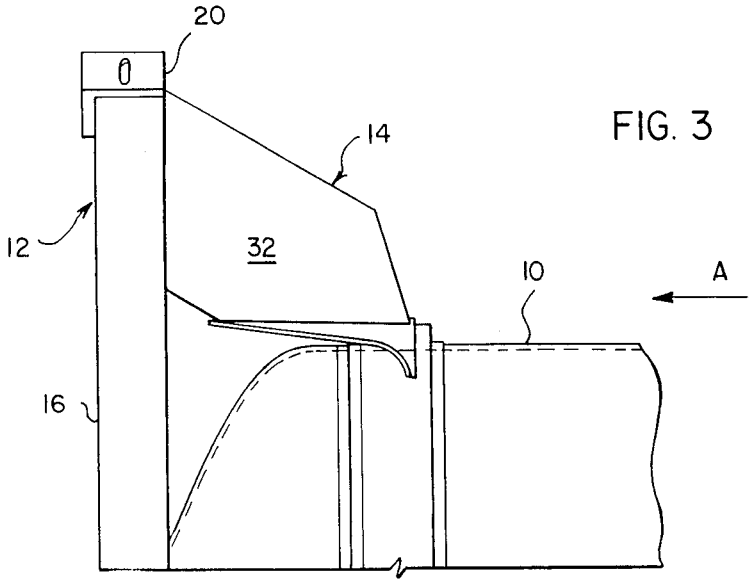
FIG. 3 is a side elevation, to an enlarged scale, of a corner structure of the beam tank.
Figure 6:
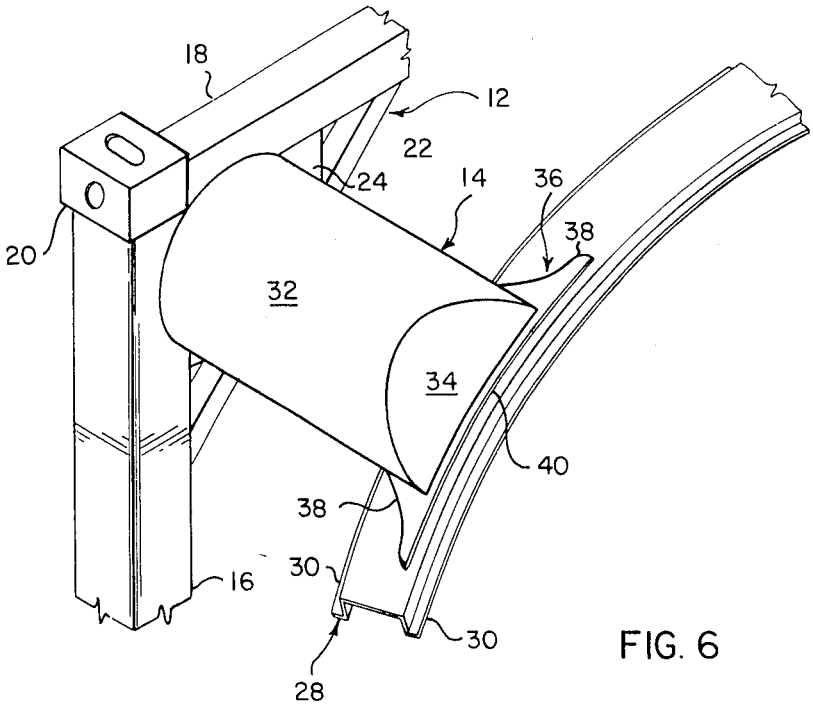
FIG. 6 is a pictorial view of the corner structure.

The tank 10 includes rolled metal plates 26 and strengthening rings 28 the preferred cross section of which is best seen in FIG. 6. The flanges 30 of the strengthening rings 28 are welded to the metal plates 26. The rings 28 can be of any other suitable shape, e.g. in the form of bar which is initially flat and is curved to arcuate section.

Each saddle 14 comprises a tubular member 32 which is constructed from a plate which is rolled to cylindrical form and then welded to form a longitudinal seam where the edges of the plate abut. Alternatively, the member 32 can be cut from a length of pipe. The longitudinal axis of each tubular member 32 is inclined (see particularly FIG. 5) and one of its ends is welded to those faces of the members 16, 18 and 22 and the filler plate 24 which lie in a common vertical plane. Because all these components have their faces in a common vertical plane, and the tubular member 32 is inclined, the lefthand end of the tubular member 32 (as viewed in FIG. 5) does not lie at right angles to its axis. The weld is endless in that it extends all around the member 32.

The hollow interior of the tubular member 32 is closed-off by two plates 34 and 36 which are welded to the tubular member 32. The smaller plate 34 is approximately semi-circular (see FIGS. 5 and 6) and is slightly inclined with respect to vertical. Along the major part of its periphery it is welded to the tubular member 32 and closes-off the otherwise open end of the member 32. Along the remainder of its periphery (the curvature of which substantially matches that of the tank 10) it is welded to the plate 36. The plate 34 is pressed to form recesses in the two spaced regions where it, the member 32 and the plate 36 meet thereby to avoid sharp transitions.

The plate 36 is welded to the member 32 and also to the strengthening ring 28. As best seen in FIG. 6, the plate 36 is wider than the tubular member 32 and includes a pair of wings 38 which protrude outwardly on each side of the tubular member 32. The plate 36 has a curvature which matches that of the strengthening ring 28, the ring 28 and plate 36 being welded together along the edge of the plate 36, which, when viewed in elevation, is straight. The weld extends just around the ends of the wings 38. The weld is thus continuous over that part of the connection between the plate 36 and the ring which is most heavily stressed.

To provide more strngth, a second ring 28.1 (see FIG. 5) can be provided, the plate 36 and the tubular member 32 being extended as shown in dotted lines. The closure plate 34.1 in this form is much smaller. The plate 36 includes two sets of wings 38, one set of wings being welded to the strengthening ring 28 and the other set of wings being welded to the strengthening ring 28.1.

While it is preferred that the member 32 be circular in cross section, it could, if desired, be elliptical or any other suitable cross sectional shape.

The rings 28 can be omitted and the plates 36 welded directly to the plates 26 if desired.

We claim:

1. A freight container comprising a pair of rectangular end frames, a tank spanning between the end frames, and saddles connecting the end frames to the tank, each saddle including a tubular member and a plate, on end of each tubular member being welded to the inner face of the adjacent end frame and each plate having a curvature which matches that of the tank, each plate comprising a main part and a pair of wings which extend circumferentially on opposite sides of said main part, each wing becoming narrower in the direction away from the main part, said main part of each plate being welded to the end of one of said tubular members remote from the end frame and said main part and said wings being welded to the outer face of the tank.

2. A container according to claim 1, in which the tank has an external strengthening ring at each end thereof, said plates being welded to the outer faces of said rings.

3. A freight container comprising a pair of rectangular end frames, a tank spanning between the end frames, and two upper saddles and two lower saddles connecting each end frame to the tank, each saddle comprising a tubular member the axis of which is inclined with respect to vertical, the lower saddles sloping upwardly from the end frames to the tank and the upper saddles sloping downwardly from the end frames to the tank, each tubular member having one end face which lies in a vertical plane and which one end faces are welded to the end frames, and the other end of each tubular member being closed off by a plate construction which is welded to the tubular member, each plate construction including a plate which comprises a main part which is welded to the tubular member and a pair of wings which extend circumferentially on opposite sides of said main part, each plate having a curvature which matches that of the tank and being welded thereto.

4. A freight container according to claim 3, wherein each wing becomes narrower in the direction away from said main part.

5. A container according to claim 3, in which the tank has an external strengthening ring at each end thereof, said plates being welded to the outer faces of said rings.

6. A freight container according to claim 3, in which each plate construction further includes a part-circular plate which is welded both to the tubular member and to said plate which includes wings.

7. A container according to claim 3, wherein each tubular member comprises a plate rolled to tubular form, the axially extending edges of each plate being welded to one another.

8. A container according to claim 3 wherein each end frame comprises vertical members and horizontal members, there being a bracing member extending across each corner of each frame and joining one of the vertical members to the adjacent horizontal member, plates being welded into the triangular spaces defined by said members, said members and said plates having faces which lie in common vertical planes, and said one ends of the saddles being welded to said faces.

9. A container according to claim 8, in which the welds joining the saddles to said faces are continuous, extending completely around said tubular members.

10. A container according to claim 1, wherein said tubular members comprise plates rolled to tubular form, the axially extending edges of each plate being welded to one another.

* * * * *